United States Patent [19]

Hilton

[11] Patent Number: 4,841,741

[45] Date of Patent: Jun. 27, 1989

[54] LIQUID COOLERS

[76] Inventor: Roy G. Hilton, 4 Gibson Street, Bowden, South Australia 5007, Australia

[21] Appl. No.: 174,377

[22] Filed: Mar. 28, 1988

[30] Foreign Application Priority Data

Apr. 13, 1987 [AU] Australia ..... PI01408
Dec. 11, 1987 [AU] Australia ..... PI05864

[51] Int. Cl.[4] ..... B67D 5/62
[52] U.S. Cl. ..... 62/394; 62/399
[58] Field of Search ..... 62/394, 399, 509, 389

[56] References Cited

U.S. PATENT DOCUMENTS 2,009,623 7/1935 Killen ..... 62/399 X
2,532,328 12/1950 Penning ..... 62/394
3,146,603 9/1964 Porter, Jr. ..... 62/394 X
3,310,103 3/1967 Osborne ..... 62/394 X
3,765,192 10/1973 Root ..... 62/509 X

FOREIGN PATENT DOCUMENTS 468170 7/1973 Australia .

*Primary Examiner*—Lloyd L. King
*Attorney, Agent, or Firm*—Roylance, Abrams, Berdo & Goodman

[57] ABSTRACT

A fluid cooler comprises a housing, a chamber located in the housing, a conduit for the fluid to be cooled and a float controlled valve for controlling the flow of liquid refrigerant into the chamber.

9 Claims, 1 Drawing Sheet

LIQUID COOLERS

This invention relates to liquid coolers for cooling beverages such as beer.

The device to which this invention is directed is an evaporator of refrigerant there being a conduit in the housing through which the liquid beverage is directed.

It is conventional to have a float within the housing so that entry of liquid refrigerants is controlled depending upon the height of the liquid within the housing.

Care must be taken to guard against mechanical breakdown of components in the event of certain operating conditions arising. Such breakdown conditions can be brought about by the introduction of warm or even hot liquid through the beverage cooling coils potentially causing a very substantial pressure build-up in the housing.

Conventionally a float support is provided in a lowermost portion of the housing upon which the float in a lowermost position can rest so that this support defines the lowermost position of the float.

However, in the event of the substantial pressure arising, the float support may collapse and the float can fall further downwards. Consequently the float can either jam or fall completely from its sliding retaining means in the event of a very low evaporative liquid level eventuating.

In the event of such malfunction the housing being a sealed unit must be removed in its entirety and returned to a factory for total dismantling and reconstruction.

In Australian patent No. 468170 one approach toward overcoming the susceptibility of these devices to the effects of excessive pressure within the housing is disclosed. Briefly a float controlled valve is suggested having a liquid needle valve assembly depending from an upper portion of the housing. The float was retained with the valve assembly to close said valve when the float was at an uppermost position, and when the float is at a lowermost position the float was supported from an upper part of the housing by direct engagement of the float with such upper part of the housing. This device has served to minimize the malfunction of the float valve and therefore the liquid cooler.

Nevertheless other problems are still associated with these improved liquid coolers. The first arises when the coolers are utilized during high summer temperatures where the condensing capacity of the condensing units is too small or blocked. In such circumstances liquid refrigerant of abnormally high temperature will be introduced to the cooler resulting in significant losses in cooling efficiency. The second problem arises if the beverage freezes in the coils. This normally results in the coils distorting which can jam up against the float system rendering it inoperative.

In an effort to minimize these problems it is proposed to at least partially isolate the float control valve by placing a chamber about it.

Accordingly there is provided a fluid cooler comprising (i) a housing having an inlet and an outlet for refrigerant and an inlet and an outlet for fluid to be cooled, (ii) a chamber located in the housing and in engagement with the housing about the inlet for refrigerant, the chamber having openings therein to permit refrigerant to pass from the chamber into a space defined between the housing and the chamber, (iii) conduit for passage of fluid to be cooled therethrough, the conduit located within the space and extending from the inlet to the outlet for the fluid to be cooled, and (iv) a float controlled valve located in the chamber for control of ingress of refrigerant into the chamber.

As the inlet for refrigerant is located to directly permit the refrigerant in liquid form to enter the chamber, the chamber will act as a pre-chilling chamber for the hot liquid refrigerant to cool down before being brought in contact with the fluid conduit. By equalizing the refrigerant temperature in both sections of the housing i.e. the space and chamber, the capacity of the cooler increases.

Further as the chamber is interposed between the coiled conduit and the float valve any distortion of the conduit due to freezing will not cause the float valve to jam.

Advantageously, the chamber located in the housing engages the housing about the inlet for liquid refrigerant. Apertures are provided to allow gaseous refrigerant to pass and equalization of the chamber and space. Liquid refrigerant will travel through the chamber and will be pre-chilled before it passes through the openings to the space. To maximise the heat exchange effect, the chamber may be extended substantially the length of the housing. In such an arrangement the openings in the chamber may be located adjacent to the far end of the chamber and the refrigerant is therefore exposed to cooling for as long a period as is possible to maximize equalization of temperature with the refrigerant already circulating in the space and about the conduit.

Again in an effort to maximise the cooling efficiency of the cooler, the conduit is made to extend about the chamber preferably as a coil. The coil will usually surround a major amount of the outer surface of the chamber.

The invention is further illustrated with the assistance of the accompanying drawings in which.

Figure 1:
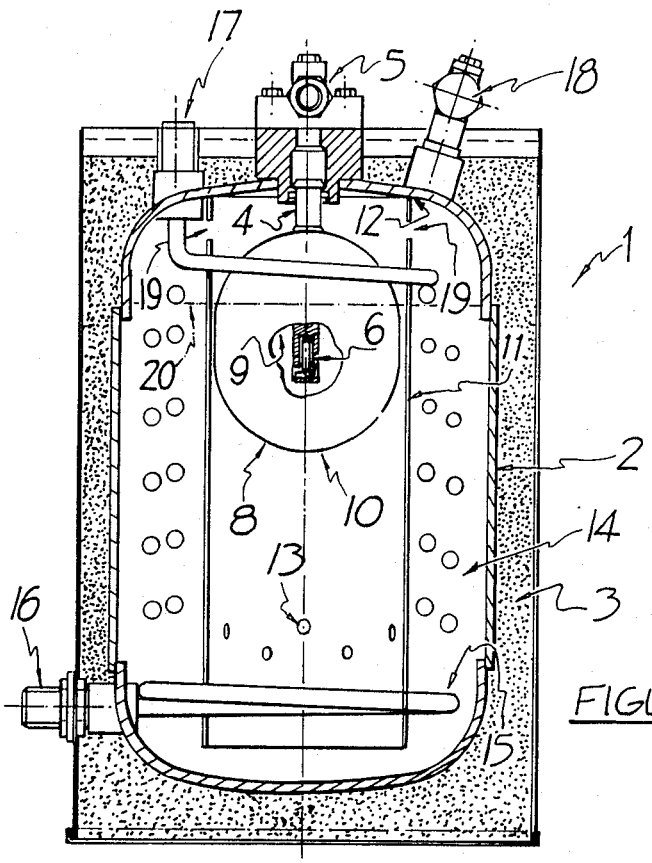
FIG. 1 is a cross-sectional view through a fluid cooler according to the invention.
Figure 2:
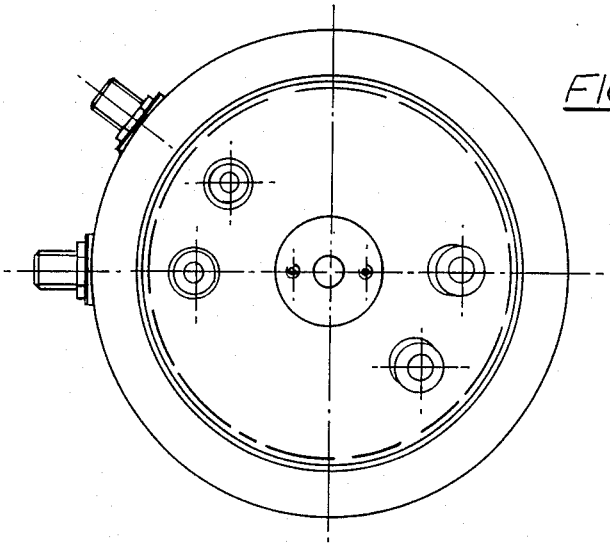
FIG. 2 is a plan view of the fluid cooler of FIG. 1.

Referring now to the drawings, the fluid cooler 1 has a housing 2 contained within an insulating surround 3.

The housing 2 has a liquid needle valve assembly 4 which extends from inlet 5. The needle valve assembly 4 includes a needle valve 6. A float 7 which is comprised of a metal shell 8 and an internal pressurized foam plastic material 9 has a tubular vertical sleeve 10 into which the liquid needle valve assembly 4 is located.

Cylindrical chamber 11 is located about and clear from float 7. The chamber 11 has upper edges 12 fixed to housing 2. The side of cylindrical chamber 11 extends downwardly from the inlet 5 for liquid refrigerant and ceases just above the bottom of housing 2. Openings 13 in the lower part of cylindrical chamber 11 permit liquid refrigerant to escape into space 14 defined by the chamber 11 and housing 2.

Fluid coiled conduit 15 totally envelope chamber 11, though for ease of understanding of the drawing the lower and upper portions of conduit 15 are only shown. Conduit 15 extends from inlet 16 to outlet 17 and fluid to be cooled passes to this conduit 15 via inlet 16, circulates about chamber 11 and escapes via outlet 17. During this passage the fluid is cooled by heat exchange with the refrigerant located in the space 14.

The liquid refrigerant is up to level 20. As the initial refrigerant must first pass through the chamber 11 before exiting into space 14, it is pre-chilled by heat exchange and its temperature equalized with that of the refrigerant in space 14 which is ultimately removed from housing 2 via refrigerant return 18. Apertures 19 are provided at the top of chamber 11 to allow gaseous refrigerant in the chamber 11 to pass into the space 14. These apertures 19 also permit pressure equalization of the chamber 11 and space 14.

Accordingly the incorporation of the pre-chill chamber into the cooler not only protects the float valve mechanism from damage but more importantly allows unsuitably warm liquid refrigerant to be pre-chilled prior to contact with fluid carrying conduits. This results in significant increases in the efficiency of the cooler and also substantially improves the working life of the cooler especially its valve mechanism.

The claims defining the invention are as follows:

1. A fluid cooler, comprising:

(i) a housing having (a) an inner wall defining a cavity for refrigerant, (b) an inlet and an outlet for refrigerant, and (c) an inlet and an outlet for fluid to be cooled;

(ii) a chamber located in the housing and in engagement with the housing about the inlet for refrigerant, the chamber having openings therein to permit refrigerant to pass from the chamber into a space between the inner wall and the chamber;

(iii) a conduit for passage of fluid to be cooled therethrough, the conduit being located within the space and extending from the inlet to the outlet for the fluid to be cooled; and (iv) a float controlled valve located in the chamber for control of ingress of liquid refrigerant into the chamber.

2. A fluid cooler according to claim 1 wherein the chamber located in the housing sealingly engages the inner wall about the inlet for refrigerant.

3. A fluid cooler according to claim 1 wherein the conduit extends about the chamber.

4. A fluid cooler according to claim 1 wherein the conduit is coiled.

5. A fluid cooler according to claim 1 wherein the chamber extends substantially the length of the cavity.

6. A fluid cooler according to claim 1 wherein the openings in the chamber are distant from the inlet for refrigerant.

7. A fluid cooler according to claim 1 wherein said chamber comprises a tubular member spaced inwardly from the inner wall of the housing.

8. A fluid cooler according to claim 7 wherein said tubular member is cylindrical.

9. A fluid cooler according to claim 1 wherein said chamber separates the space from an inner volume of the chamber in which the float controlled valve is located.

* * * * *